US012662283B2

(12) United States Patent
Yamada

(10) Patent No.: US 12,662,283 B2
(45) Date of Patent: Jun. 23, 2026

(54) CUSHIONING AND PACKAGING MATERIAL

(71) Applicant: FUJIFILM Business Innovation Corp., Tokyo (JP)

(72) Inventor: Keigo Yamada, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 18/188,476

(22) Filed: Mar. 23, 2023

(65) Prior Publication Data

US 2024/0083621 A1 Mar. 14, 2024

(30) Foreign Application Priority Data

Sep. 8, 2022 (JP) ..... 2022-142629

(51) Int. Cl.
*B65D 81/05* (2006.01)
*B65D 5/50* (2006.01)

(52) U.S. Cl.
CPC ..... *B65D 5/5035* (2013.01); *B65D 81/05* (2013.01)

(58) Field of Classification Search
CPC ..... B65D 81/05; B65D 81/07; B65D 81/075; B65D 5/5035
USPC ..... 206/583, 591, 592, 594
See application file for complete search history.

(56) References Cited

U.S. PATENT DOCUMENTS 5,915,556 A * 6/1999 Simpson ..... B65D 81/05 206/521
9,932,162 B2 * 4/2018 Stack, Jr. ..... B65D 5/5016
10,035,638 B1 * 7/2018 LeRoy ..... B65D 5/6652
11,530,084 B1 * 12/2022 Brand ..... B65D 5/5035
2011/0024324 A1 * 2/2011 Tanner ..... B65D 81/075 206/588
2011/0240515 A1 * 10/2011 Ridgeway ..... B65D 5/5028 53/472
2020/0339333 A1 * 10/2020 Numminen ..... B65D 5/5088
2023/0150718 A1 * 5/2023 Mack ..... B65D 81/07 229/164.2

FOREIGN PATENT DOCUMENTS

| | | |
|---|---|---|
| JP | H10119995 | 5/1998 |
| JP | 2007039052 | 2/2007 |
| JP | 2008087837 | 4/2008 |
| JP | 2010241497 | 10/2010 |
| JP | 3231038 | 3/2021 |
| JP | 2022043948 | 3/2022 |

OTHER PUBLICATIONS

"Notice of Reasons for Refusal of Japan Counterpart Application", issued on Apr. 14, 2026, with English translation thereof, p. 1-p. 3.

* cited by examiner

*Primary Examiner* — Luan K Bui
(74) *Attorney, Agent, or Firm* — JCIPRNET

(57) ABSTRACT

Cushioning constituting a part of a box configured to accommodate an object to be packaged includes: a bottom plate on which the object to be packaged is to be placed; a top plate including a cushioning portion having a cushioning function, the cushioning portion and the bottom plate being configured to hold the object to be packaged therebetween; and a folding portion to be folded from the top plate over the bottom plate to apply tension to the cushioning portion holding the object to be packaged.

20 Claims, 7 Drawing Sheets

CUSHIONING AND PACKAGING MATERIAL

CROSS-REFERENCE TO RELATED APPLICATIONS

This application is based on and claims priority under 35 USC 119 from Japanese Patent Application No. 2022-142629 filed Sep. 8, 2022.

BACKGROUND

(i) Technical Field

The present disclosure relates to cushioning and a packaging material.

(ii) Related Art

A known box with cushioning can accommodate various shapes and sizes of objects in a state in which the object is held in the box.

For example, Japanese Unexamined Patent Application Publication No. 2022-43948 discloses a box with cushioning. The box includes a box body and a lid. The cushioning includes a body portion having circumferentially provided discontinuous slits and standing portions provided so as to be continuous with the body portion via folding lines. When the cushioning is disposed on an object to be accommodated disposed in the box body of the box, and the standing portions are pushed in, the body portion is deformed so as to conform to the outer shape of the object and covers the object. Then, by closing the lid, flap portions come into contact with distal-end sides of the standing portions.

Furthermore, for example, Japanese Unexamined Patent Application Publication No. 2008-87837 discloses a packaging container including a box and an interior layer to be fitted into the box body to hold an article. At least the interior layer is formed by pressing a semi-rigid or semi-elastic integrated plate material, such as corrugated cardboard or thick paper, into a box shape such that the interior layer can be accommodated in the box body. In the pressing, numerous slits are uniformly or substantially uniformly provided over the entire or substantially the entire surface of an article-holding wall, serving as a bottom wall, of the box-shaped interior layer. When the slits are opened and widened in the shape of an open mouth due to the load of the article, the holding wall expands and contracts so as to be elastically deformed in a concave shape from the periphery to the center while being stretched.

SUMMARY

When cushioning that is deformed so as to conform to the shape of an object to be packaged to wrap the object is formed of a part of a box accommodating the object, the cushioning once deformed has a poor ability to restore to the original state, and it is difficult for the cushioning to maintain a pressing force on the object. In particular, when the box and the cushioning are made of paper, and the paper is made to serve as cushioning, this tendency is more obvious.

Aspects of non-limiting embodiments of the present disclosure relate to maintaining a pressing force on an object to be packaged exerted by cushioning when the cushioning wraps the object by being deformed so as to conform to the shape of the object and is formed of a part of a box for accommodating the object.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided cushioning constituting a part of a box configured to accommodate an object to be packaged, the cushioning including: a bottom plate on which the object to be packaged is to be placed; a top plate including a cushioning portion having a cushioning function, the cushioning portion and the bottom plate being configured to hold the object to be packaged therebetween; and a folding portion to be folded from the top plate over the bottom plate to apply tension to the cushioning portion holding the object to be packaged.

BRIEF DESCRIPTION OF THE DRAWINGS

Exemplary embodiment of the present disclosure will be described in detail based on the following figures, wherein.

DETAILED DESCRIPTION

An exemplary embodiment of the present disclosure will be described below with reference to the accompanying drawings.

Figure 1:
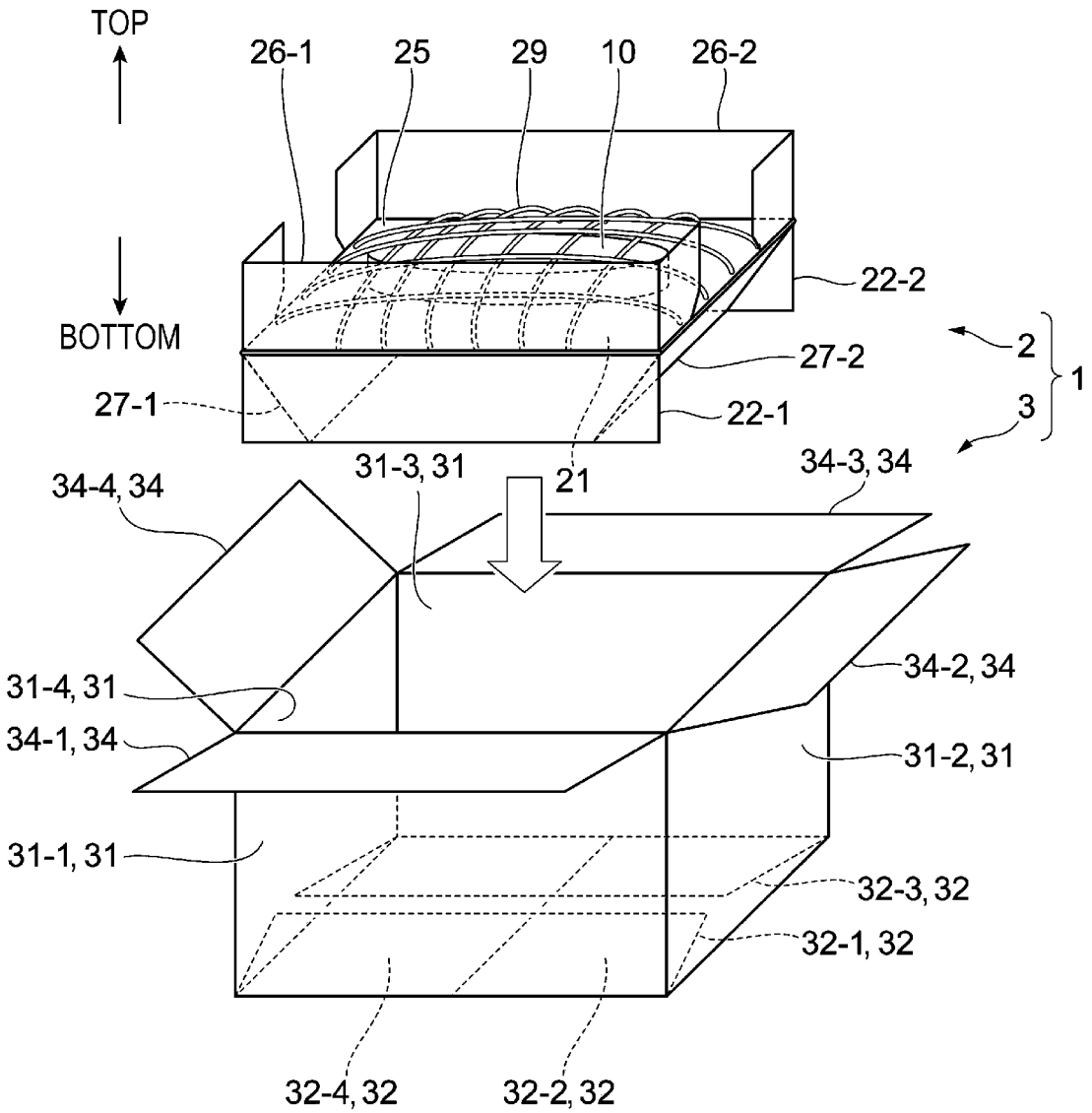
FIG. 1 shows a situation in which an object to be packaged is stored in a packaging material having cushioning according to an exemplary embodiment.

FIG. 1 shows a situation in which an object to be packaged 10 is accommodated in a packaging material 1 having cushioning 2 according to this exemplary embodiment.

The packaging material 1 according to this exemplary embodiment includes the cushioning 2 for holding the object to be packaged 10 and a box 3 for accommodating the cushioning 2. The cushioning 2 and the box 3 according to this exemplary embodiment are formed of so-called corrugated cardboard. The corrugated cardboard is formed by joining thick paper to both sides of corrugated paper, and is composed of paper members.

The cushioning 2 according to this exemplary embodiment holds the object to be packaged 10 with its own cushioning structure. The cushioning 2 holding the object to be packaged 10 is accommodated in the box 3 such that an appropriate space is maintained between the object to be packaged 10 and the inner surface of the box 3 as much as possible or such that an impact to the object to be packaged 10 applied from the outside is reduced as much as possible even when the object to be packaged 10 and the inner surface of the box 3 come into contact with each other. The cushioning 2 is provided with multiple slits. As a result of at least some of the slits being opened in accordance with the shape of the object to be packaged 10, the cushioning 2 can hold multiple types of objects to be packaged 10 having different shapes.

The cushioning 2 includes a bottom plate 21, on which the object to be packaged 10 is to be placed, and a top plate 25, which wraps the object to be packaged 10 placed on the bottom plate 21. The bottom plate 21 and the top plate 25 have rectangular shapes having substantially the same size. The top plate 25 has a cushioning portion 29 having a cushioning function and provided with various slits that enable the top plate 25 to wrap the object to be packaged 10. The top plate 25 is a part of a box for accommodating an object to be packaged and holds the object to be packaged 10 between the cushioning portion 29 and the bottom plate 21, on which the object to be packaged 10 is placed. In other words, when the top plate 25 is disposed on the object to be packaged 10 placed on the bottom plate 21, the slits provided in the cushioning portion 29 are opened, and the cushioning portion 29 of the top plate 25 is deformed so as to conform to the shape of the object to be packaged 10.

The cushioning 2 includes support legs 22-1 and 22-2 that allow the bottom plate 21 to float from a bottom surface 32 of the box 3. The support legs 22-1 and 22-2 are provided along parallel sides of the rectangular bottom plate 21 and are folded at approximately 90 degrees with respect to the bottom plate 21. The support legs 22-1 and 22-2 are an example of bottom-plate support portions that extend in a direction in which the surface on the reverse side of the surface on which the object to be packaged 10 is placed faces (i.e., downward) from the bottom plate 21 to support the bottom plate 21.

The cushioning 2 also includes support arms 26-1 and 26-2 that limit movement of the bottom plate 21 in the upward direction in FIG. 1. The support arms 26-1 and 26-2 are provided along parallel sides of the rectangular top plate 25 and are folded at approximately 90 degrees with respect to the top plate 25 and the bottom plate 21. The support arms 26-1 and 26-2 are an example of top-plate support portions that extend from the top plate 25 in a direction in which the surface on which the object to be packaged 10 is placed faces (i.e., upward).

When the top plate 25 is disposed on the bottom plate 21 with the object to be packaged 10 therebetween, the side along which the support leg 22-1 is provided and the side along which the support arm 26-1 is provided are substantially aligned. When the top plate 25 is disposed on the bottom plate 21, the side along which the support leg 22-2 is provided and the side along which the support arm 26-2 is provided are substantially aligned.

The cushioning 2 also includes folding portions 27-1 and 27-2 that apply tension to the top plate 25. The folding portions 27-1 and 27-2 are provided along two sides along which the support arms 26-1 and 26-2 are not provided among the four sides of the rectangular top plate 25. The folding portions 27-1 and 27-2 are provided so as to be foldable from the top plate 25 over sides of the bottom plate 21. When the folding portions 27-1 and 27-2 provided at ends of the top plate 25 so as to be foldable are folded from the top plate 25 over the sides of the bottom plate 21, the sides at the ends of the top plate 25 are pulled, increasing the tension generated in the top plate 25. As a result of this increase in tension, the holding force of the top plate 25 for holding the object to be packaged 10 is increased.

The box 3 is formed in a cubic shape, and one face of the cubic box 3 can be opened and closed. The box 3 includes a tubular body 31 constituting the side surfaces, a bottom surface 32 that closes one opening of the tubular body 31, and a lid portion 34 that can open and close the other opening of the body 31.

The body 31 includes wall portions 31-1, 31-2, 31-3, and 31-4. Each of the wall portions 31-1, 31-2, 31-3, and 31-4 has a rectangular shape.

The bottom surface 32 includes bottom flaps 32-1, 32-2, 32-3, and 32-4 provided at the lower ends of the wall portions 31-1, 31-2, 31-3, and 31-4 via folding lines. Each of the bottom flaps 32-1, 32-2, 32-3, and 32-4 has a rectangular shape. The bottom surface 32 is formed by folding a pair of opposing bottom flaps 32-1 and 32-3 inward at approximately 90 degrees with respect to the wall portions 31-1 and 31-3, respectively, folding the bottom flaps 32-2 and 32-4 inward at approximately 90 degrees with respect to the wall portions 31-2 and 31-4, respectively, so that the edges are butted against each other, and then fixing the edges. The edges are fixed with adhesive tape, adhesive, screws, or the like.

The lid portion 34 includes top-surface flaps 34-1, 34-2, 34-3, and 34-4 provided at the upper edges of the wall portions 31-1, 31-2, 31-3, and 31-4. By opening the top-surface flaps 34-1, 34-2, 34-3, and 34-4, the cushioning 2 in the box 3 can be taken out of the box 3 through the opening.

Next, the structure of the cushioning 2 will be described in detail with reference to FIG. 2.

Figure 2:
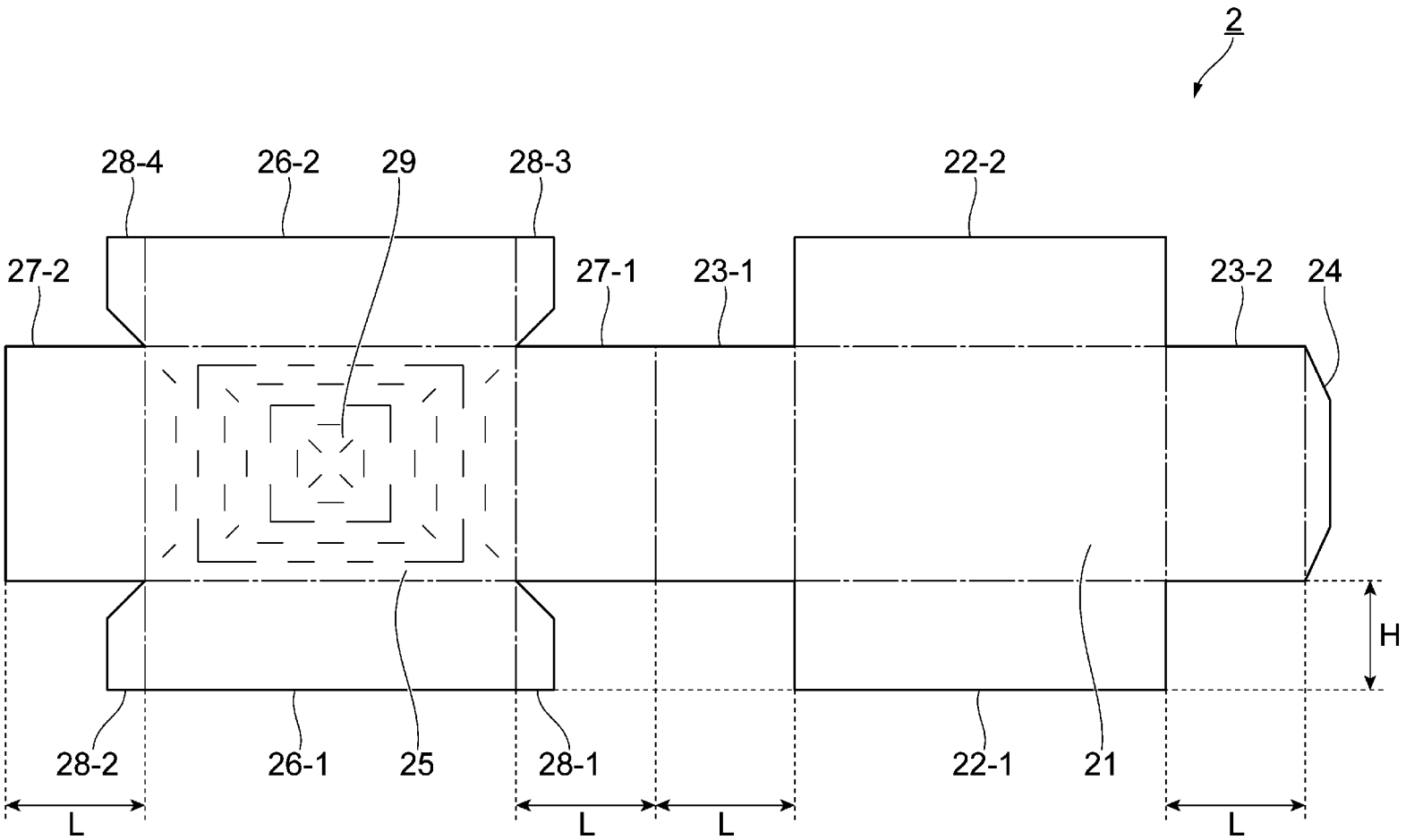
FIG. 2 is an unfolded view of the cushioning according to the exemplary embodiment.

FIG. 2 is an unfolded view of the cushioning 2 according to this exemplary embodiment.

The cushioning 2 is formed as a single sheet member by performing cutting, slitting, adding folding lines, and the like to plate-like corrugated cardboard. In this exemplary embodiment, although plate-like corrugated cardboard is used as the sheet member, thick paper, a resin material, or the like may also be used.

The support leg 22-1 extending from the bottom plate 21 of the cushioning 2 is provided along one longitudinally extending side of the bottom plate 21 via a folding line. The support leg 22-2 is provided, via a folding line, along another side parallel to the side along which the support leg 22-1 is provided.

The cushioning 2 is configured such that the bottom plate 21 and the top plate 25 are continuous. Connecting structures for connecting the bottom plate 21 and the top plate 25 include connecting portions 23-1 and 23-2 extending from the bottom plate 21 and the above-described folding portions 27-1 and 27-2 extending from the top plate 25. The connecting portions 23-1 and 23-2 have a rectangular shape and are provided along parallel sides of the bottom plate 21. Specifically, the connecting portion 23-1 is provided along one side of the bottom plate 21 via a folding line, and the connecting portion 23-2 is provided, via a folding line, along another side parallel to the one side along which the connecting portion 23-1 is provided.

The cushioning 2 includes a glue margin 24 via which the folding portion 27-2 and the connecting portion 23-2 are glued together. In the example illustrated in FIG. 2, the glue margin 24 extends from the connecting portion 23-2 and is provided along a side of the connecting portion 23-2 via a folding line. When the top plate 25 is disposed on the bottom plate 21 with the object to be packaged 10 therebetween, the glue margin 24 is bonded to an end of the folding portion 27-2 to join the folding portion 27-2 and the connecting portion 23-2. Although the glue margin 24 is provided on the connecting portion 23-2 of the bottom plate 21 in this exemplary embodiment, the glue margin 24 may be provided on the folding portion 27-2 of the top plate 25.

The top plate 25 has the cushioning portion 29 provided with multiple slits, as shown in FIG. 2, that enable the top plate 25 to wrap the object to be packaged 10. In the example shown in FIG. 2, discontinuous slits are provided along the peripheries of multiple rectangles with different side lengths. The side lengths are larger on the outer side and smaller on the inner side, so, the rectangles on the inner side are smaller. The slits are provided at intervals along the peripheries of these rectangles. In the example shown in FIG. 2, the centers of the rectangles and the center of the rectangular top plate 25 are aligned. In addition to the slits provided along the peripheries of the rectangles, slits extending in directions intersecting the sides of the rectangles at, for example, 45 degrees are provided.

The slits provided in the cushioning portion 29 are not limited to those illustrated in FIG. 2 and are provided as appropriate depending on the shape of the object to be packaged 10 and the like.

As mentioned above, the cushioning 2 includes two support arms 26-1 and 26-2. The support arm 26-1 is provided along one side of the rectangular top plate 25, the support arm 26-2 is provided along another side parallel to the one side along which the support arm 26-1 is provided. The support arms 26-1 and 26-2 are foldable from the top plate 25. The height (i.e., the length in the upward direction shown in FIG. 1) of the support arms 26-1 and 26-2 when folded from the top plate 25 is greater than the height of the object to be packaged 10 when pressed by the top plate 25. This makes it possible to maintain an appropriate space between the object to be packaged 10 and the inner surface of the box 3, and an impact applied to the object to be packaged 10 from the outside can be reduced. Furthermore, an impact applied to the object to be packaged 10 when the box 3 is turned upside down can be reduced.

The cushioning 2 according to this exemplary embodiment includes anti-falling flaps 28-1, 28-2, 28-3, and 28-4 that prevent the support arms 26-1 and 26-2 from falling when the cushioning 2 is assembled and put into the box 3. Herein, a total of four (i.e., multiple) anti-falling flaps, 28-1, 28-2, 28-3, and 28-4, are provided such that two anti-falling flaps are provided on each of the rectangular support arms, 26-1 and 26-2. In this exemplary embodiment, each of the anti-falling flaps 28-1, 28-2, 28-3, and 28-4 has a substantially trapezoidal shape whose long side is a side of the support arm 26-1 or 26-2.

The folding portion 27-1 of the cushioning 2 is provided in a foldable manner so as to be continuous with the connecting portion 23-1, which is provided in a foldable manner so as to be continuous with the bottom plate 21. The folding length L of the folding portion 27-1 is the same as the folding length L of the connecting portion 23-1. Therefore, as described above, the folding portions 27-1 and 27-2 of the cushioning 2 increase the tension generated in the top plate 25. When the top plate 25 is disposed on the bottom plate 21 with the object to be packaged 10 therebetween, the folding portions 27-1 and 27-2 overlap the connecting portions 23-1 and 23-2 of the bottom plate 21, respectively.

Because the connecting portion 23-1 and the folding portion 27-1 are continuous, there is no need for alignment, making assembly easy, compared with a case where, for example, the bottom plate 21 and the top plate 25 are separated. The connecting portion 23-1 and the folding portion 27-1, and the connecting portion 23-2 and the folding portion 27-2, which are to be overlapped each other, have a rectangular shape and have a folding length L. The folding length L is greater than the height H, which is the length of the bottom-plate support portions. When the object to be packaged 10 held between the bottom plate 21 and the top plate 25 is put into the box 3, the position of the base is determined by the height H of the support legs 22-1 and 22-2. Because the folding length L is greater than the height H, the ends of the folding portions 27-1 and 27-2 are necessarily in contact with the inner bottom of the box 3 (see FIG. 1).

Next, the operation of the cushioning 2 according to this exemplary embodiment will be described with reference to FIGS. 1 and 2.

The cushioning 2 according to this exemplary embodiment is plate-like cushioning configured as in the unfolded view in FIG. 2, and holds the object to be packaged 10 after being assembled.

When the cushioning 2 is assembled, first, the object to be packaged 10 is placed on the bottom plate 21 of the cushioning 2. Then, the cushioning 2 is folded at a portion between the connecting portion 23-1 and the folding portion 27-1, and the top plate 25 is disposed on the bottom plate 21 such that the top plate 25 is pressed against the object to be packaged 10.

Thereafter, the end of the folding portion 27-2 and the glue margin 24 are bonded to join the folding portion 27-2 and the connecting portion 23-2. The bonding may be performed during the assembly described below.

Then, the support legs 22-1 and 22-2 are folded by approximately 90 degrees with respect to the bottom plate 21 such that the ends thereof point downward in FIG. 1. The support arms 26-1 and 26-2 are folded by approximately 90 degrees with respect to the top plate 25 such that the ends thereof point upward. By folding the support legs 22-1 and 22-2 downward and the support arms 26-1 and 26-2 upward, the dimension of the folded cushioning 2 in the height direction (i.e., vertical direction) and the dimension of the box 3 in the depth direction (i.e., vertical direction inside the box 3) become equal. Thus, the movement of the cushioning 2 in the box 3 is restricted.

Then, the anti-falling flaps 28-1, 28-2, 28-3, and 28-4 are folded from the support arms 26-1 and 26-2, which have been folded upward from the top plate 25. At this time, the anti-falling flaps 28-1, 28-2, 28-3, and 28-4 are folded by approximately 90 degrees with respect to the support arms 26-1 and 26-2 so that the ends thereof point inward.

When the folding portions 27-1 and 27-2 are folded such that the ends thereof point downward, the cushioning 2 is assembled in the form shown in FIG. 1.

The movement of the object to be packaged 10, held between the bottom plate 21 and the top plate 25, on the bottom plate 21 is suppressed by deformation of the slits provided in the cushioning portion 29. As described above, the movement of the bottom plate 21 and the top plate 25 in the box 3 is restricted by the support legs 22-1 and 22-2 and the support arms 26-1 and 26-2. Accordingly, the cushioning 2 according to this exemplary embodiment can suppress the movement of the object to be packaged 10 in the box 3.

Note that the above-described order of folding the support legs 22-1 and 22-2, the support arms 26-1 and 26-2, the anti-falling flaps 28-1, 28-2, 28-3, and 28-4, and the folding portions 27-1 and 27-2 is an example and is not limited thereto.

As described above, the cushioning 2 according to this exemplary embodiment is used in such a manner that the object to be packaged 10 is placed on the bottom plate 21, and then the top plate 25 is disposed thereon. When the top plate 25 is disposed on the bottom plate 21 after the object to be packaged 10 is placed on the bottom plate 21, the slits provided in the cushioning portion 29 are opened, and the cushioning portion 29 is deformed so as to conform to the shape of the object to be packaged 10. Because the cushioning portion 29 is deformed so as to conform to the shape of the object to be packaged 10, the four sides of the top plate 25 are subjected to forces in contracting directions. As a result, the four sides of the top plate 25 are brought inward toward the periphery of the object to be packaged 10. When no measures are taken, the four sides of the top plate 25 wrapping the object to be packaged 10 are pulled inward of the rectangular shape, which is the outer shape of the bottom plate 21.

The cushioning 2 according to this exemplary embodiment is configured such that the folding portions 27-1 and 27-2 provided along sides of the top plate 25 via folding lines are folded along the sides of the top plate 25 over the bottom plate 21. When the folding portions 27-1 and 27-2 are folded, the sides of the top plate 25 provided with the folding lines are pulled so as to overlap the sides of the bottom plate 21. This increases the tension generated on the outer side of the top plate 25, and tension is applied to the cushioning portion 29 wrapping the object to be packaged 10. When the tension is applied to the cushioning portion 29, the pressing force applied from the cushioning portion 29 to the object to be packaged 10 increases. Thus, it is possible to increase the holding force of the cushioning portion 29 for holding the object to be packaged 10. Folding the folding portions 27-1 and 27-2 along the sides of the top plate 25 may also distribute the pressure applied to the object to be packaged 10.

In the cushioning 2 according to this exemplary embodiment, when the object to be packaged 10 is placed on the bottom plate 21, and the top plate 25 is disposed thereon, the folding portion 27-1 and the connecting portion 23-1 overlap each other, and the folding portion 27-2 and the connecting portion 23-2 overlap each other. Therefore, when the folding portions 27-1 and 27-2 are folded along the sides of the top plate 25 over the bottom plate 21, the connecting portions 23-1 and 23-2 are also folded. Because the connecting portions 23-1 and 23-2 are folded with the folding portions 27-1 and 27-2, the two sides of the top plate 25 are pulled further outward by an amount corresponding to the thickness of the connecting portions 23-1 and 23-2. Hence, higher tension is applied to the cushioning portion 29 compared with a case where the connecting portions 23-1 and 23-2 are not folded with the folding portions 27-1 and 27-2.

Although the above-described cushioning 2 has the folding portions 27-1 and 27-2 at ends of the top plate 25, a configuration without one of the folding portions 27-1 and 27-2 is also possible. For example, one side of the bottom plate 21 and one side of the top plate 25 may be directly connected without the folding portion 27-1 and the connecting portion 23-1 in FIG. 2. In this case, after the object to be packaged 10 is placed on the bottom plate 21, the top plate 25 is folded by approximately 180 degrees with respect to the bottom plate 21 and is pressed against the object to be packaged 10, so that the cushioning portion 29 wraps the object to be packaged 10. Thereafter, the folding portion 27-2 is folded from the top plate 25 over the bottom plate 21 to apply tension to the cushioning portion 29 that wraps the object to be packaged 10.

As described above, because the folding length L is greater than the height H, the ends of the folding portions 27-1 and 27-2 are necessarily in contact with the inner bottom of the box 3. Hence, the folding portions 27-1 and 27-2 are maintained in a folded state. Therefore, the support leg 22-1 is maintained in a state of being held between the wall portion 31-1 of the box 3 and the folding portions 27-1 and 27-2, and thus is prevented from falling. Similarly, the support leg 22-2 is maintained in a state of being held between the wall portion 31-3 of the box 3 and the folding portions 27-1 and 27-2, and thus is prevented from falling.

Because the folding length L is greater than the height H, the ends of the folding portions 27-1 and 27-2 are in contact with the inner bottom of the box 3. Hence, when the cushioning 2 is put in the box 3 and transported, the folding angles of the folding portions 27-1 and 27-2 are maintained in the box 3.

Next, the packaging material 1 according to this exemplary embodiment will be described with reference to FIGS. 1 and 3.

Figure 3:
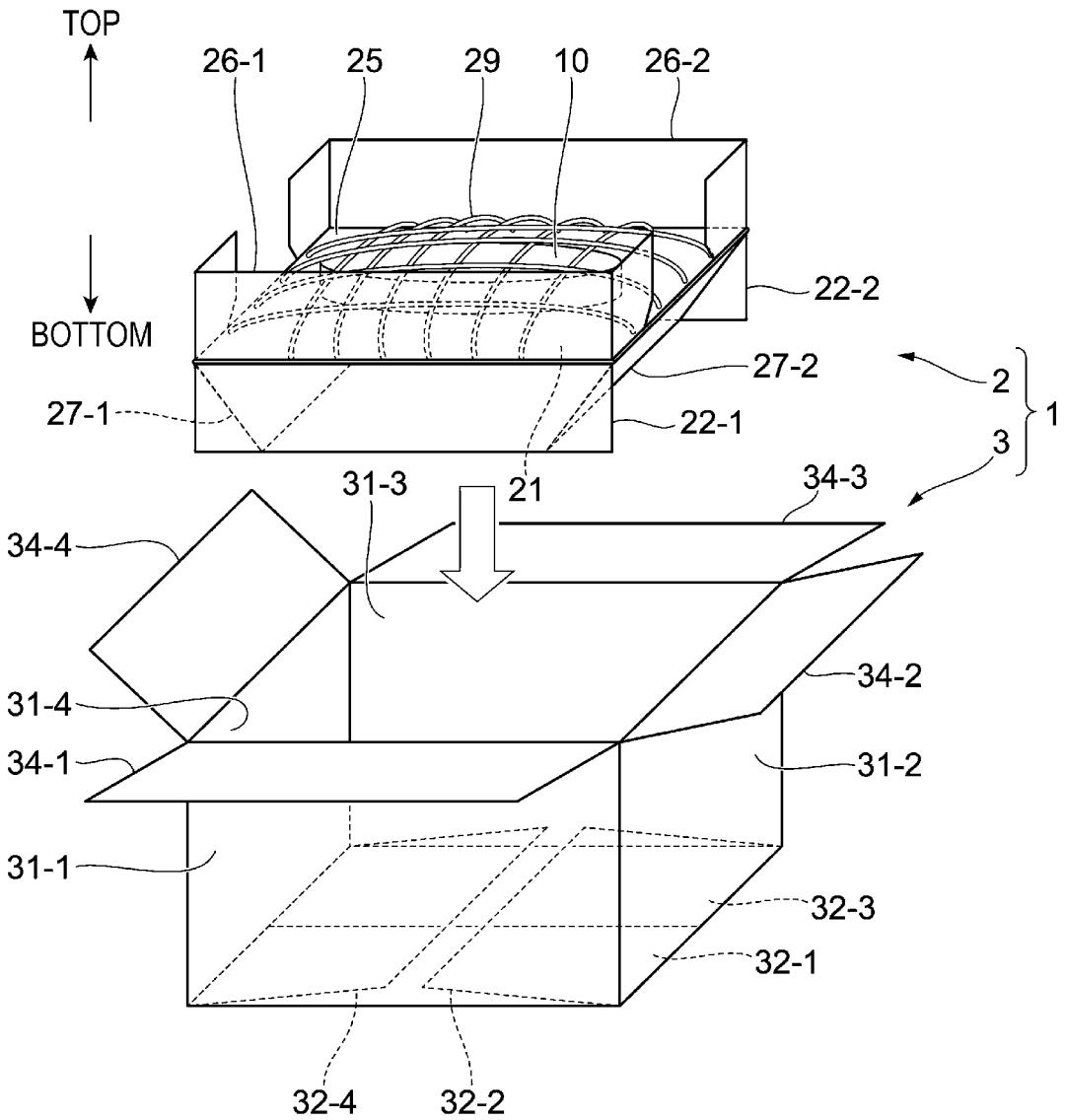
FIG. 3 shows an example in which the box is partially different from the box in FIG. 1.

FIG. 3 shows an example in which the box 3 is partially different from that in FIG. 1. FIG. 3 differs from FIG. 1 in the positional relationship of the bottom flaps 32-1, 32-2, 32-3, and 32-4 of the box 3.

Specifically, FIGS. 1 and 3 differ in the order of folding the bottom flaps 32-1, 32-2, 32-3, and 32-4. In FIG. 1, the bottom flaps 32-1 and 32-3 of the box 3 are positioned on the inner side of the box 3 than the bottom flaps 32-2 and 32-4. In FIG. 3, the bottom flaps 32-2 and 32-4 of the box 3 are positioned on the inner side of the box 3 than the bottom flap 32-1 and 32-3.

In FIG. 1, the bottom flaps 32-1 and 32-3 tend to be inclined upward from the sides continuous with the wall portions 31-1 and 31-3 toward the ends. In the cushioning 2 according to this exemplary embodiment, as described above, the folding length L (see FIG. 2) of the folding portions 27-1 and 27-2 is greater than the height H (see FIG. 2) of the support legs 22-1 and 22-2. Therefore, when the cushioning 2 is accommodated in the box 3 with the folding portions 27-1 and 27-2 being folded at an acute angle, the ends of the folding portions 27-1 and 27-2 come into contact with the ends of the bottom flaps 32-1 and 32-3 of the box 3.

The folding portions 27-1 and 27-2 in contact with the ends of the bottom flaps 32-1 and 32-2 receive an upward force from the bottom flaps 32-1 and 32-3. In other words, the bottom flaps 32-1 and 32-3 act in a direction in which the folding angle of the folding portions 27-1 and 27-2 becomes more acute.

In FIG. 3, the bottom flaps 32-2 and 32-4 tend to be inclined upward from the sides continuous with the wall portions 31-2 and 31-4 toward the ends. Therefore, as shown in FIG. 3, when the cushioning 2 is accommodated in the box 3 with the folding portions 27-1 and 27-2 being folded at an acute angle, the ends of the support legs 22-1 and 22-2 come into contact with the ends of the bottom flaps 32-2 and 32-4 of the box 3.

The support legs 22-1 and 22-2 in contact with the bottom flaps 32-2 and 32-4 receive an upward force from the bottom flaps 32-2 and 32-4. This prevents the support legs 22-1 and 22-2 from coming into close contact with the bottom flaps 32-1 and 32-3, which directly come into contact with the outside. Thus, an impact transmitted from the bottom flaps 32-1 and 32-3 to the support legs 22-1 and 22-2 is reduced.

Next, cushioning 6, which is a modification of the cushioning 2, will be described with reference to FIGS. 4 and 5.

Figure 4:
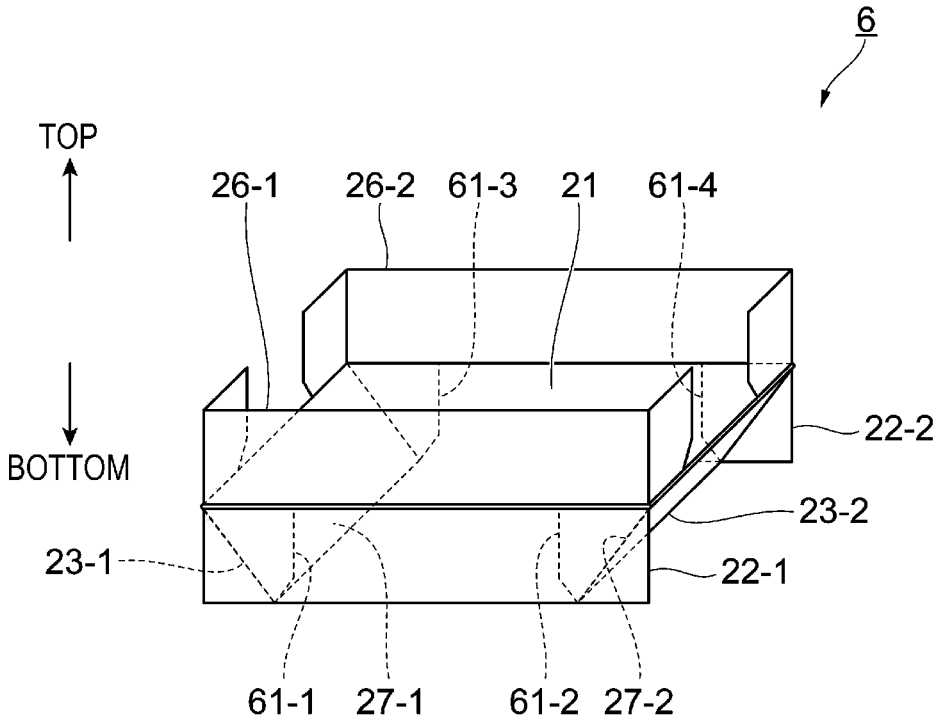
FIG. 4 shows a modification of the cushioning.
Figure 5:
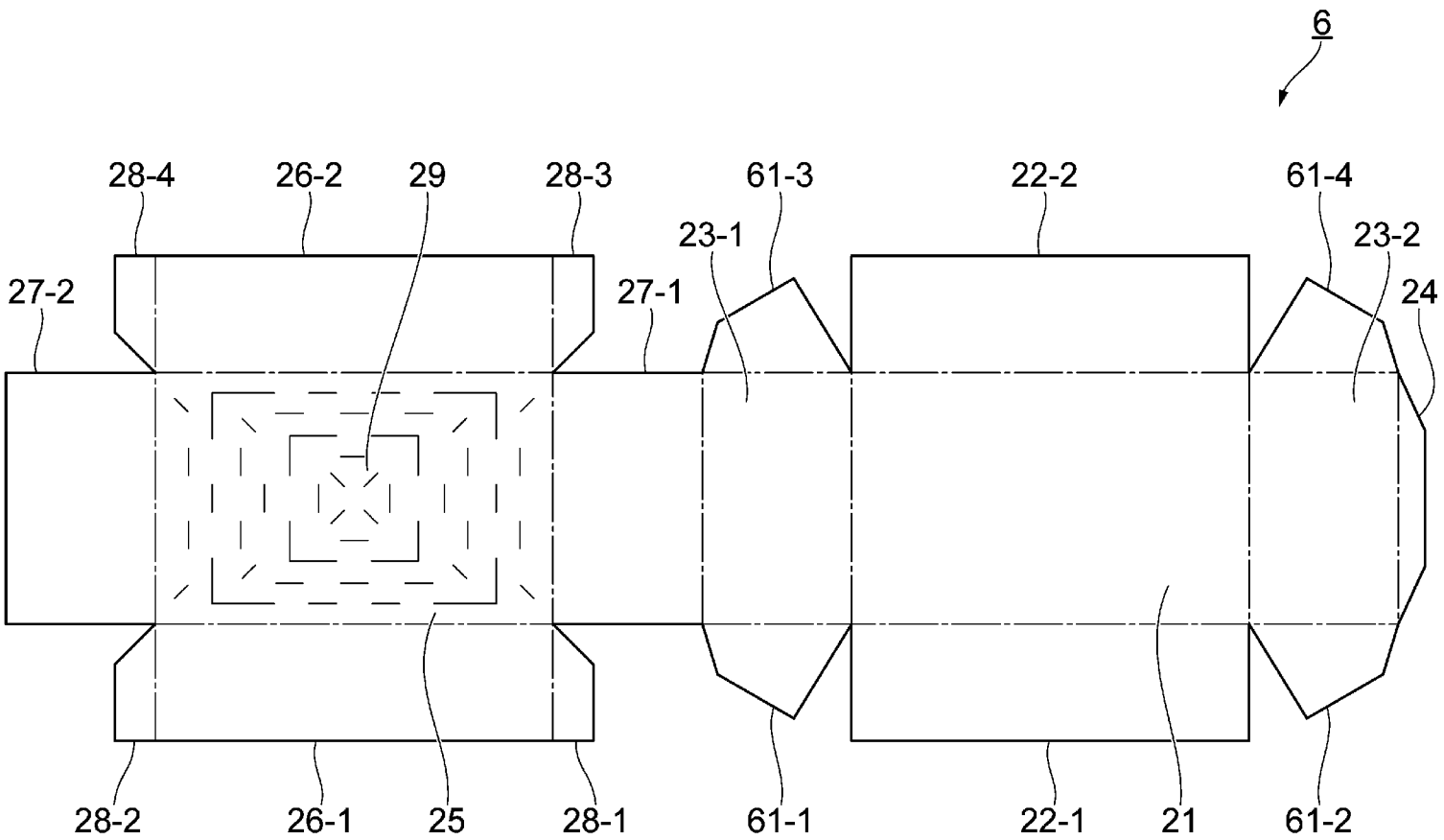
FIG. 5 is an unfolded view of a modification of the cushioning.

FIG. 4 shows the cushioning 6, which is a modification of the cushioning 2. FIG. 5 is an unfolded view of the cushioning 6. In the cushioning 6, the same functions as those of the cushioning 2 in FIG. 1 described above will be denoted by the same reference signs, and detailed descriptions thereof will be omitted.

The cushioning 6 according to the modification further includes first cushioning flaps 61-1, 61-2, 61-3 and 61-4, in addition to the configuration of the cushioning 2. A total of four first cushioning flaps, 61-1 to 61-4, are provided, such that two first cushioning flaps are provided on each of the rectangular connecting portions 23-1 and 23-2. Each of the first cushioning flaps 61-1 to 61-4 has a quadrangular shape whose one side is one side of the connecting portion 23-1 or the connecting portion 23-2. As shown in FIG. 4, the first cushioning flaps 61-1 to 61-4 extending from the connecting portions 23-1 and 23-2 are folded and come into contact with the bottom plate 21. In this state, the surfaces of the first cushioning flaps 61-1 to 61-4 become vertical, and the first cushioning flaps 61-1 to 61-4 can reduce an impact applied from the lower side.

In addition to the folding lines, cutoff lines may be provided between the connecting portion 23-1 and the first cushioning flap 61-1, between the connecting portion 23-1 and the first cushioning flap 61-3, between the connecting portion 23-2 and the first cushioning flap 61-2, and between the connecting portion 23-2 and the first cushioning flap 61-4. The cutoff lines are perforations that enable a person to tear corrugated cardboard by hand. The first cushioning flaps 61-1 to 61-4 can be easily removed depending on the situation in which the cushioning 6 is used. For example, when the first cushioning flaps 61-1 to 61-4 limit the folding angle of the folding portions 27-1 and 27-2, the first cushioning flaps 61-1 to 61-4 may be removed so that the folding portions 27-1 and 27-2 can be folded at a more acute angle.

Next, cushioning 7, which is another modification of the cushioning 2, will be described with reference to FIG. 6.

Figure 6:
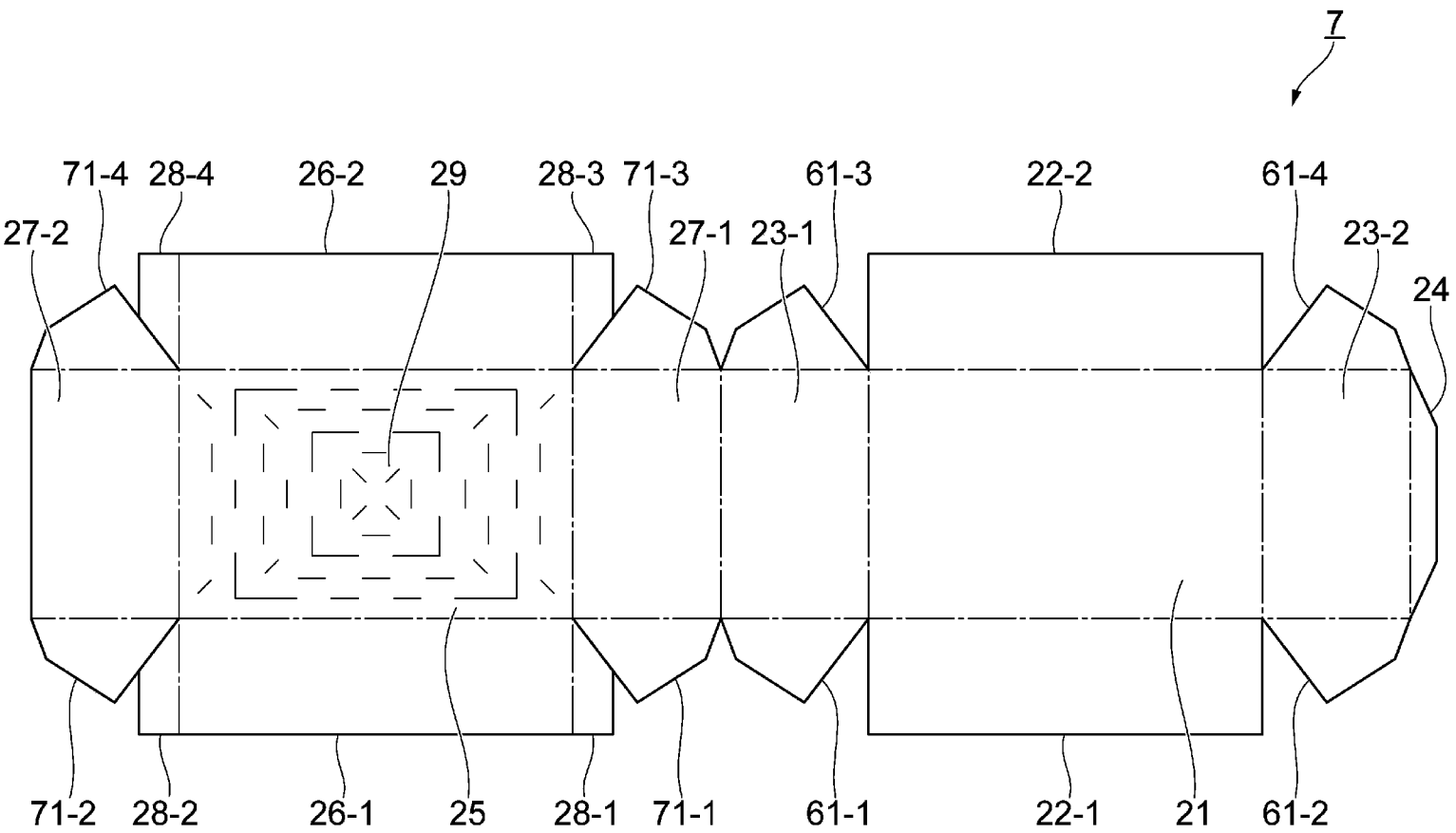
FIG. 6 is an unfolded view of another modification of the cushioning.

FIG. 6 is an unfolded view of the cushioning 7 according to another modification of the cushioning 2. The cushioning 7 according to another modification further includes second cushioning flaps 71-1, 71-2, 71-3, and 71-4, in addition to the configuration of the cushioning 6 shown in FIGS. 4 and 5.

A total of four second cushioning flaps, 71-1 to 71-4, are provided, such that two second cushioning flaps are provided on each of the rectangular folding portions 27-1 and 27-2. In addition to the folding lines, cutoff lines are provided along the sides where the second cushioning flaps 71-1 to 71-4 are provided. In this modification, each of the second cushioning flaps 71-1 to 71-4 has a quadrangular shape whose one side is one side of the folding portion 27-1 or the folding portion 27-2. Similarly to the second cushioning flaps 61-1 to 61-4, the second cushioning flaps 71-1 to 71-4 have a quadrangular shape whose one side is one side of the folding portion 27-1 or the folding portion 27-2.

When the cushioning 7 is assembled, the first cushioning flap 61-1 and the second cushioning flap 71-1, the first cushioning flap 61-2 and the second cushioning flap 71-2, the first cushioning flap 61-3 and the second cushioning flap 71-3, and the first cushioning flap 61-4 and the second cushioning flap 71-4 overlap each other. Thus, the cushioning 7 can withstand a higher impact than the cushioning 6.

The first cushioning flaps 61-1 to 61-4 and the second cushioning flaps 71-1 to 71-4 may have different shapes. For example, one or both of the first cushioning flaps 61-1 to 61-4 and the second cushioning flaps 71-1 to 71-4 may be removed depending on the angle at which the folding portions 27-1 and 27-2 are folded.

Next, other situations in which the cushioning 2 is inserted into the box 3 will be described.

Figure 7:
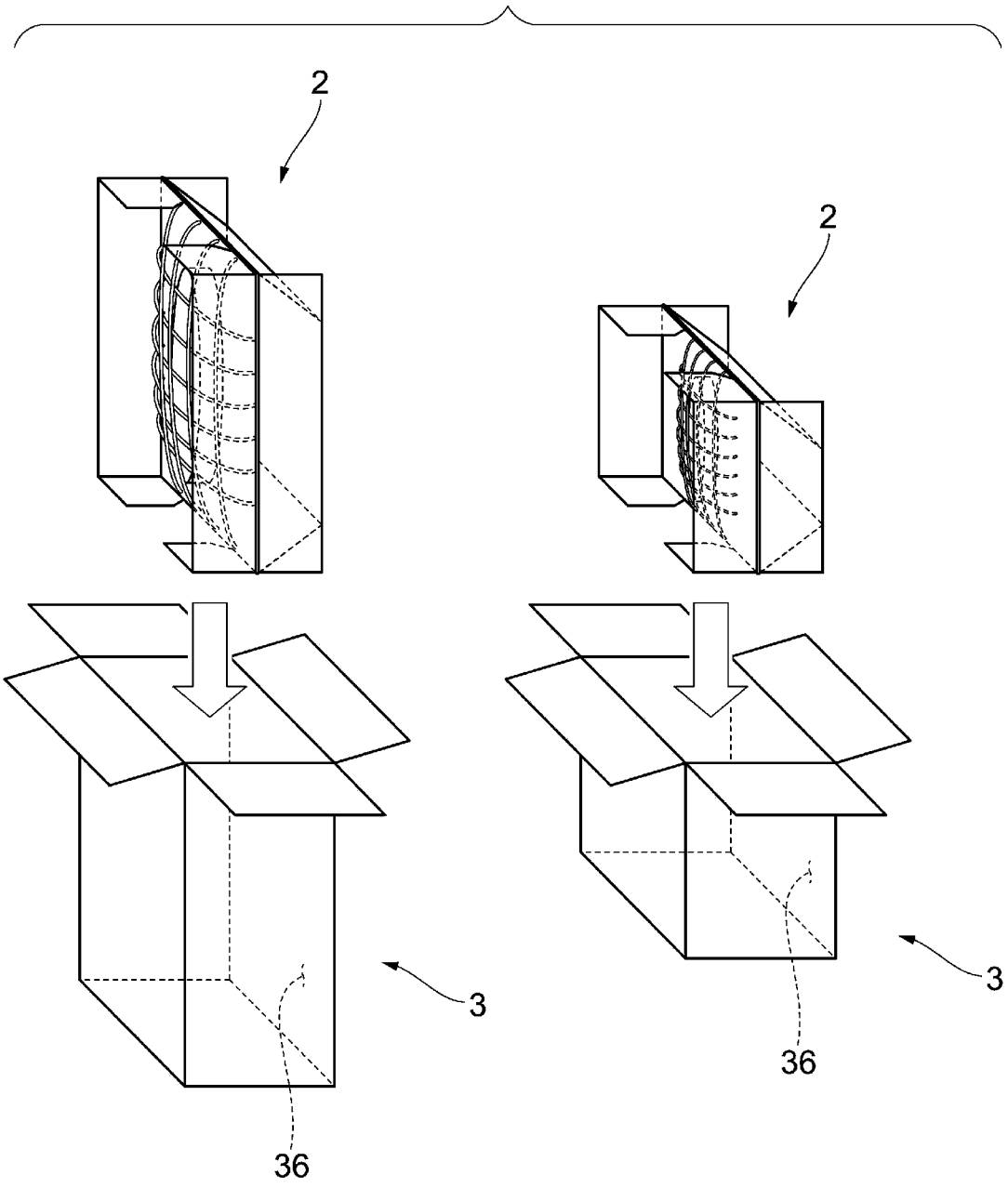
FIG. 7 shows other situations in which the cushioning is inserted into a box.

FIG. 7 shows other situations in which the cushioning 2 is inserted into the box 3. Although the cushioning 2 alone is described here for the convenience of explanation, the cushioning 6 and 7 are also handled in the same way.

In the examples shown in FIG. 7, the orientation of the cushioning 2 when inserted into the box 3 is different from that in FIGS. 1 and 3, and the cushioning 2 is slid into the box 3. Specifically, the cushioning 2 oriented in the vertical direction is accommodated in the box 3.

As shown in FIG. 7, when the vertically oriented cushioning 2 is accommodated in the box 3, it is possible to maintain the folding angle of the folding portions 27-1 and 27-2 with a hand until the folding portions 27-1 and 27-2 come into contact with an inner wall 36 of the box 3. Thus, the folding angle is maintained.

By changing the height of the support legs 22-1 and 22-2 and the support arms 26-1 and 26-2, the cushioning 2 according to this exemplary embodiment can be used with boxes 3 of various sizes.

Furthermore, the height of the support legs 22-1 and 22-2 and the height of the support arms 26-1 and 26-2 may differ from each other. For example, by making the height of the support legs 22-1 and 22-2 smaller, it is possible to lower the center of gravity of the entire packaging material 1 accommodating the object to be packaged 10.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. Cushioning constituting a part of a box configured to accommodate an object to be packaged, the cushioning comprising:

a bottom plate on which the object to be packaged is to be placed;

a top plate including a cushioning portion having a cushioning function, the cushioning portion and the bottom plate being configured to hold the object to be packaged therebetween;

a folding portion to be folded from the top plate over the bottom plate to apply tension to the cushioning portion holding the object to be packaged, and a bottom-plate support portion that extends from the bottom plate in a direction in which a surface on the reverse side of a surface on which the object to be packaged is placed faces to support the bottom plate, the folding portion is folded along sides of the top plate over the bottom plate to apply tension to the cushioning portion holding the object to be packaged, wherein a folding length of the folding portion is greater than a length of the bottom-plate support portion.

2. The cushioning according to claim 1, wherein:

the folding portion includes two folding portions.

3. The cushioning according to claim 1, wherein the bottom plate, the bottom-plate support portion, the top plate, and the folding portions are formed of a single sheet member.

4. The cushioning according to claim 3, further comprising a connecting portion provided in a foldable manner so as to be continuous with the bottom plate, wherein the connecting portion and the folding portion are provided in a foldable manner so as to be continuous with each other.

5. The cushioning according to claim 4, wherein the folding length of the folding portions and a folding length of the connecting portion are equal.

6. The cushioning according to claim 5, further comprising a top-plate support portion that extends from the top plate in a direction in which the surface on which the object to be packaged is placed faces.

7. A packaging material comprising:
the cushioning according to claim 1; and
a box that accommodates the cushioning therein.

8. A packaging material comprising:
the cushioning according to claim 2; and
a box that accommodates the cushioning therein.

9. A packaging material comprising:
the cushioning according to claim 3; and
a box that accommodates the cushioning therein.

10. A packaging material comprising:
the cushioning according to claim 4; and
a box that accommodates the cushioning therein.

11. A packaging material comprising:
the cushioning according to claim 5; and
a box that accommodates the cushioning therein.

12. A packaging material comprising:
the cushioning according to claim 6; and
a box that accommodates the cushioning therein.

13. The cushioning according to claim 4, further comprising a first cushioning flap that extends from the connecting portion and comes into contact with the bottom plate vertically to the bottom plate.

14. The cushioning according to claim 13, further comprising a cutoff line which is provided between the connecting portion and the first cushioning flap.

15. The cushioning according to claim 4, further comprising a first cushioning flap that extends from the connecting portion; and
a second cushioning flap that extends from the folding portion,
wherein at least one of the first cushioning flap or the second cushioning flap come into contact with the bottom plate.

16. The cushioning according to claim 15, wherein a first angle differs from a second angle,
the first angle is formed between a tangent line which is made of the first cushioning flap and the connecting portion and an edge of the first cushioning flap contacting the bottom plate, and
the second angle formed between a tangent line which is made of the second cushioning flap and the folding portion and an edge of the second cushioning flap contacting the bottom plate.

17. The cushioning according to claim 16, further comprising cutoff lines which are provided between the connecting portion and the first cushioning flap, and between the folding portion and the second cushioning flap.

18. A packaging material comprising: the cushioning according to claim 13; and a box that accommodates the cushioning therein.

19. A packaging material comprising: the cushioning according to claim 15; and a box that accommodates the cushioning therein.

20. A packaging material comprising: the cushioning according to claim 16; and a box that accommodates the cushioning therein.

* * * * *